US009188125B2

(12) United States Patent
Kanaizumi et al.

(10) Patent No.: US 9,188,125 B2
(45) **Date of Patent: *Nov. 17, 2015**

(54) SCROLL FLUID MACHINE WITH COOLING DUCT

(71) Applicant: Hitachi Industrial Equipment Systems Co., Ltd., Chiyoda-ku, Tokyo (JP)

(72) Inventors: Atsushi Kanaizumi, Yokohama (JP); Toshitsugu Suzuki, Kunitachi (JP); Kazutaka Suefuji, Ebina (JP); Yoshiyuki Kanemoto, Samukawa (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/302,951

(22) Filed: Jun. 12, 2014

(65) Prior Publication Data

US 2014/0294641 A1 Oct. 2, 2014

Related U.S. Application Data

(63) Continuation of application No. 12/630,429, filed on Dec. 3, 2009, now Pat. No. 8,858,203.

(30) Foreign Application Priority Data

Mar. 2, 2009 (JP) ..... 2009-048105

(51) Int. Cl.
*F04C 29/04* (2006.01)
*F04C 18/02* (2006.01)
*F04C 23/00* (2006.01)

(52) U.S. Cl.
CPC ..... *F04C 18/0215* (2013.01); *F04C 23/005* (2013.01); *F04C 29/04* (2013.01)

(58) Field of Classification Search
CPC ..... F04C 18/0215; F04C 23/005; F04C 29/04
USPC ..... 418/55.1–55.6
See application file for complete search history.

(56) References Cited

U.S. PATENT DOCUMENTS 4,129,405 A * 12/1978 McCullough ..... 418/55.2
5,417,554 A 5/1995 Kietzman et al.

(Continued)

FOREIGN PATENT DOCUMENTS

JP 59-203893 A 11/1984
JP 4-342801 A 11/1992

(Continued)

OTHER PUBLICATIONS

English language abstract of Japanese Office Action dated Sep. 18, 2012 (One (1) pages).

*Primary Examiner* — Mary A Davis
*Assistant Examiner* — Paul Thiede
(74) *Attorney, Agent, or Firm* — Crowell & Moring LLP

(57) ABSTRACT

In a scroll air compressor as a scroll fluid machine capable of being downsized with an increased cooling effect, cooling air entering through a fixed inlet of a fixed cooling passage provided at the rear of a fixed scroll, and an orbiting inlet of an orbiting cooling passage provided at the rear of an orbiting scroll, is allowed to flow out of an fixed outlet and an orbiting outlet, respectively. Thereafter, the cooling air is guided to an outer periphery of the other end of the casing through a side duct and a guide duct, and then sucked into an inner peripheral side of a centrifugal fan to be discharged outwardly from an exhaust port provided in a fan cover.

9 Claims, 14 Drawing Sheets

(56) References Cited

U.S. PATENT DOCUMENTS

| | | | | |
|---|---|---|---|---|
| 5,470,213 | A * | 11/1995 | Iguchi et al. | 418/55.2 |
| 5,775,888 | A | 7/1998 | Sakamoto et al. | |
| 6,190,145 | B1 * | 2/2001 | Fujioka et al. | 418/55.1 |
| 7,014,435 | B1 * | 3/2006 | Yanagisawa et al. | 418/55.2 |
| 7,309,219 | B2 | 12/2007 | Komai et al. | |
| 7,329,108 | B2 | 2/2008 | Tsuchiya et al. | |
| 7,950,913 | B2 | 5/2011 | Suefuji et al. | |
| 8,858,203 | B2 * | 10/2014 | Kanaizumi et al. | 418/55.1 |
| 2002/0039534 | A1 | 4/2002 | Moroi et al. | |
| 2002/0102174 | A1 | 8/2002 | Suefuji et al. | |
| 2007/0077159 | A1 * | 4/2007 | Tsuchiya et al. | 418/55.1 |
| 2007/0212244 | A1 | 9/2007 | Futagami et al. | |
| 2009/0087331 | A1 | 4/2009 | Komai et al. | |
| 2009/0169406 | A1 * | 7/2009 | Ueno et al. | 418/55.6 |
| 2010/0028185 | A1 | 2/2010 | Kobayashi et al. | |
| 2010/0111740 | A1 | 5/2010 | Ni | |
| 2011/0000243 | A1 | 1/2011 | Jabbour et al. | |
| 2012/0189480 | A1 | 7/2012 | Yamazaki et al. | |
| 2012/0315174 | A1 | 12/2012 | Iwano et al. | |

FOREIGN PATENT DOCUMENTS

| | | |
|---|---|---|
| JP | 5-78988 U | 10/1993 |
| JP | 7-35064 A | 2/1995 |

* cited by examiner

SCROLL FLUID MACHINE WITH COOLING DUCT

CROSS REFERENCE TO RELATED APPLICATIONS

This application is a continuation of U.S. application Ser. No. 12/630,429, filed Dec. 3, 2009, the entire disclosure of which is incorporated herein by reference, which claims priority under 35 U.S.C. 119 to Japanese Patent Application No. 2009-048105, filed on Mar. 2, 2009, the priority of which is also claimed here.

BACKGROUND OF THE INVENTION

1. Field of the Invention

The present invention relates to a scroll fluid machine usable in an air compressor, a vacuum pump, an expansion machine, and the like.

2. Description of the Related Art

In the related art, a scroll fluid machine includes a scroll fluid machine main body provided with: a cylindrical casing; a fixed scroll mounted on one end of the casing; an orbiting scroll provided in the casing to form plural compression chambers between the fixed scroll and the orbiting scroll; a driving shaft with a crank formed at one end thereof connected to the orbiting scroll in the casing and with the other end thereof protruding outward from the other end of the casing; and a cooling fan provided on the other end of the driving shaft outside the casing. Furthermore, the related art scroll fluid machine includes a cylindrical cooling duct totally surrounding the scroll fluid machine main body (see Japanese Published Unexamined Utility Model Application No. H5-78988).

One side of the cooling duct surrounds the outer peripheral side of the fixed scroll and the outer peripheral side of the casing through an annular space. The cooling duct is reduced in diameter at the periphery of the other end of the casing so as to conform the outer shape of the other end of the casing, and thereafter, increased again in diameter at the outer peripheral side of the cooling fan to surround the cooling fan through the annular space. Also, on one end of the cooling duct, an inlet is formed in a portion of the cooling duct opposed to the center of the fixed scroll. On the other end of the cooling duct, an upwardly opening outlet is formed in a portion of the cooling duct on the outer peripheral side of the cooling fan.

In the related art scroll fluid machine having such a structure, when the driving shaft is rotated by an electric motor, the orbiting scroll is allowed to perform an orbiting motion with respect to the fixed scroll, and the cooling fan is rotated, so that cooling air is sucked into the cooling duct through the inlet of the cooling duct. And then, the cooling air flows through the outer peripheral space of the fixed scroll and the casing formed within the cooling duct, and is compressed by a portion reduced in diameter of the cooling duct at the periphery of the other end of the casing to be sent to the inner periphery of the cooling fan. Finally, the cooling air sent to the inner periphery of the cooling fan is discharged from the outlet formed on the outer peripheral side of the cooling fan.

In the above-described scroll fluid machine according to the related art, since the scroll fluid machine main body is totally surrounded by the cooling duct, there has been a problem that the scroll fluid machine is increased in size.

SUMMARY OF THE INVENTION

Accordingly, the present invention has been made in view of, for example, the above-described problem, and an object of the present invention is to provide a scroll fluid machine capable of being downsized, with an increased cooling effect.

According to an aspect of the present invention, a scroll fluid machine includes: a fixed cooling passage provided on a rear of the fixed scroll, with a fixed inlet on one radial side of the fixed scroll and a fixed outlet on the other radial side of the fixed scroll; an orbiting cooling passage provided on a rear of the orbiting scroll, with an orbiting inlet on one radial side of the casing and an orbiting outlet on the other radial side of the casing; a cooling air passage with one end communicating with the fixed outlet and the orbiting outlet, and the other end communicating with an inner peripheral side of the centrifugal fan through an outer periphery of the other end of the casing; and a fan cover surrounding the centrifugal fan, with an inner peripheral portion connected to the other end of the cooling air passage and with an outer peripheral portion having an exhaust port for discharging a cooling medium coming from the centrifugal fan.

According to an aspect of the present invention, the scroll fluid machine can be downsized, with an increased cooling effect.

DETAILED DESCRIPTION OF PREFERRED EMBODIMENTS

Hereinafter, a scroll fluid machine according to embodiments of the present invention will be described in detail with reference to the accompanying drawings, using an oilless scroll air compressor as an example of the scroll fluid machine.

First Embodiment

First of all, a scroll air compressor according to a first embodiment of the present invention will be described with reference to FIGS. 1 to 8.

Figure 1:
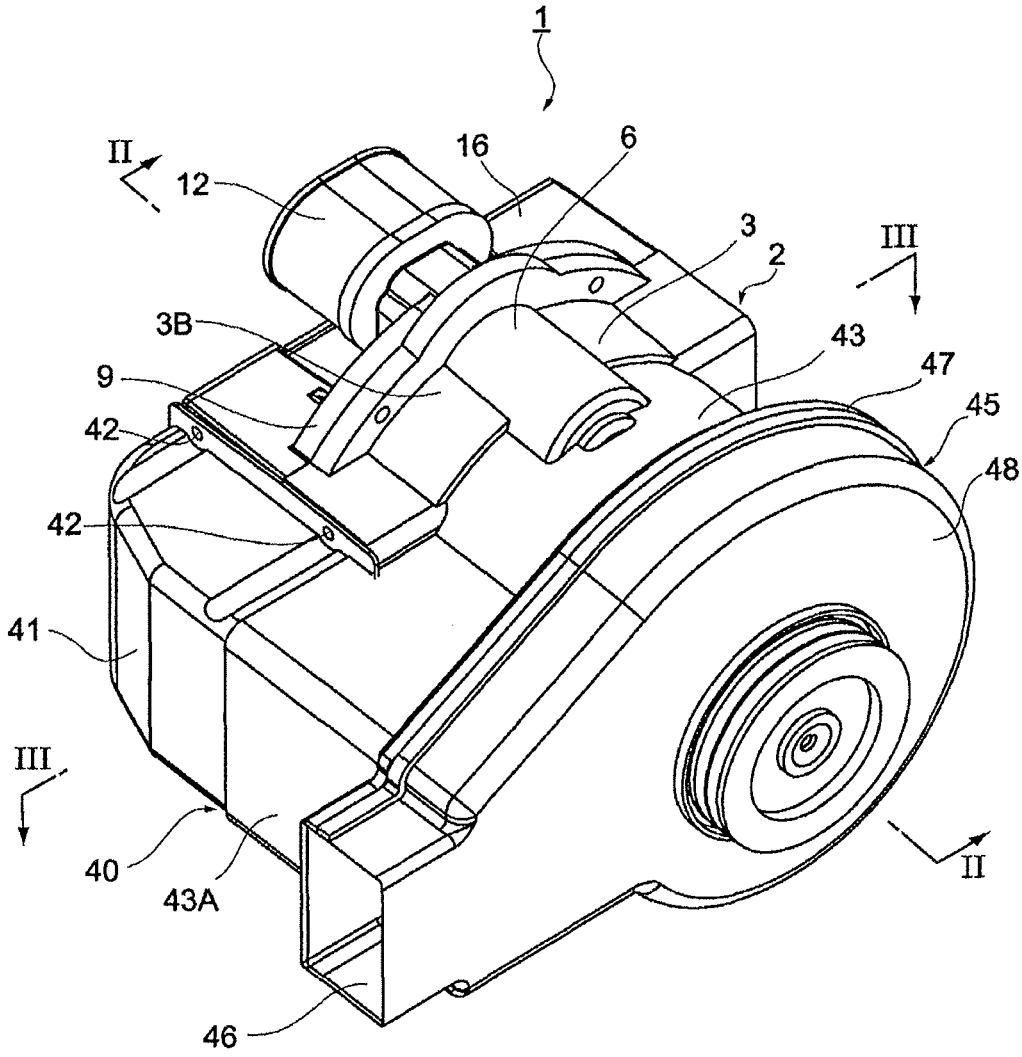
FIG. 1 is a perspective view of a scroll air compressor according to a first embodiment of the present invention.
Figure 2:
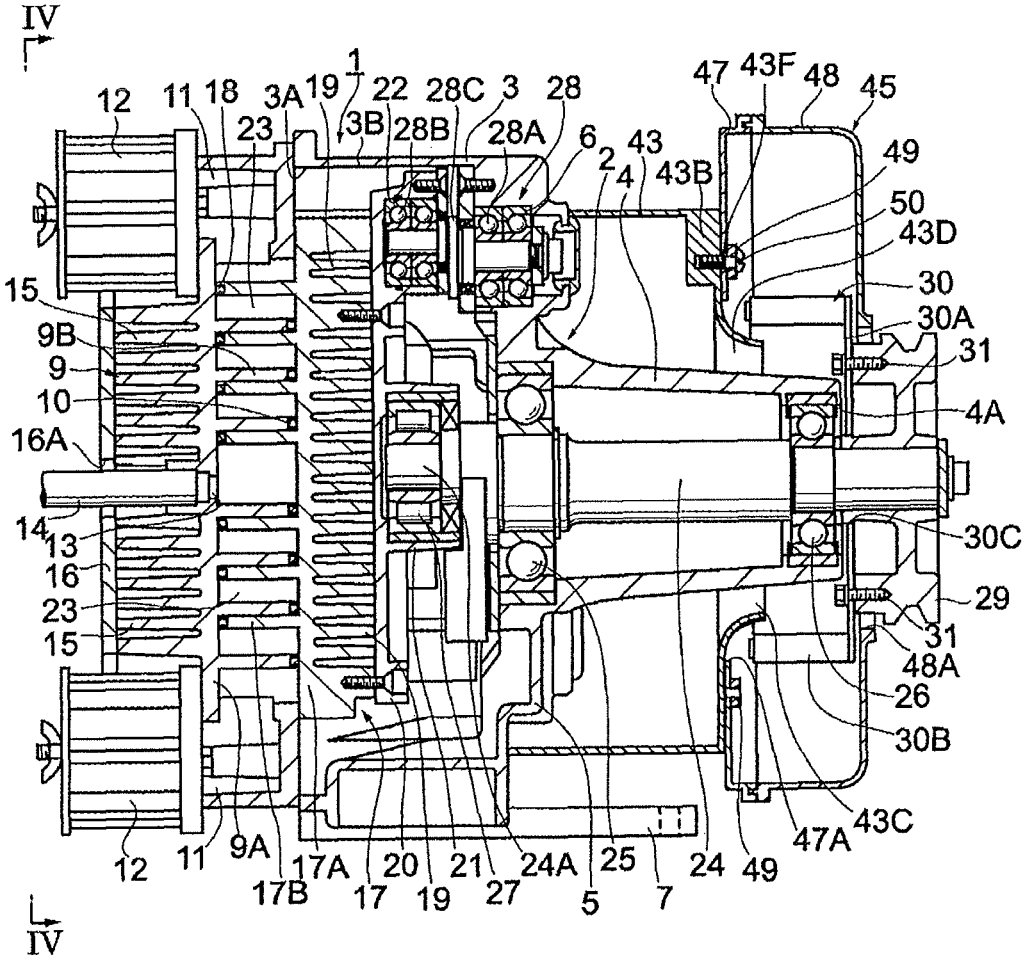
FIG. 2 is a longitudinal sectional view of the scroll air compressor taken in the direction of arrow II-II of FIG. 1.

In FIG. 1, reference numeral 1 denotes a scroll air compressor according to the first embodiment of the present invention. The scroll air compressor 1 is disposed with the central axis of a cylindrical casing 2, to be described later, horizontal. Reference numeral 2 denotes a cylindrical casing forming the outer frame of the scroll air compressor 1. The cylindrical casing 2 is formed of metal, for example, metallic materials such as cast iron and aluminum. As shown in FIG. 2, the casing 2 is composed of a large-diameter cylinder portion 3 having an opening 3A at one axial end thereof; a bushing 4 formed with a diameter smaller than the large-diameter cylinder portion 3 and having an opening 4A at the other axial end thereof; and a stepped portion 5 formed between the bushing 4 and the large-diameter cylinder portion 3. Also, on the stepped portion 5, there are provided bearing accommodating portions 6, for example, three, for each accommodating a bearing 28A of an auxiliary crank mechanism 28 to be described later. These bearing accommodating portions 6 are disposed evenly spaced apart from one another in a circumferential direction.

Here, the cylindrical casing of the present invention may be formed of a circular cylinder, a square cylinder, or other shapes with an opening at either end thereof.

A portion of the lateral surface of one axial end of the casing 2, more specifically, a portion 3B on at least the upper side of the lateral surface of the large-diameter cylinder portion 3 as shown in FIG. 1, is exposed to the outside without being surrounded by a side duct 41, a guide duct 43, and the like, to be described later.

Also, in FIG. 2, reference numeral 7 denotes a leg portion for supporting the scroll air compressor 1, with the central axis of the casing 2 horizontal. The leg portion 7 is provided on a lower portion of the lateral surface of the large-diameter cylinder portion 3. As described above, the leg portion 7 is formed integrally with the metallic casing 2 instead of being attached to a resin material such as the guide duct 43, thereby obtaining a structure with high rigidity.

Figure 3:
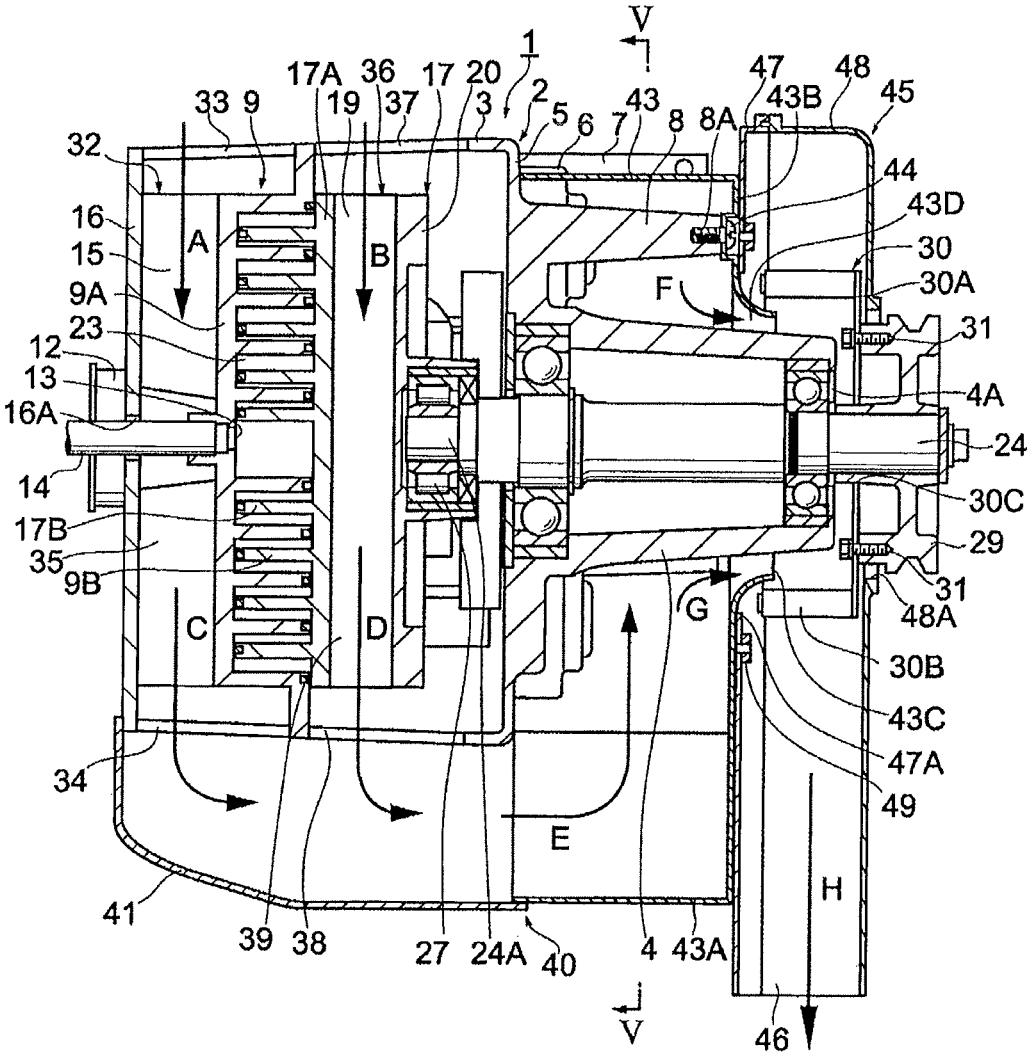
FIG. 3 is a longitudinal sectional view of the scroll air compressor taken in the direction of arrow III-III of FIG. 1.

Further, in FIG. 3, reference numeral 8 denotes a duct fixing portion for fixing the guide duct 43 to the casing 2. The duct fixing portions 8, for example, three, are provided spaced apart from one another in a circumferential direction, on the outer peripheral side of the other axial side surface of the stepped portion 5. The duct fixing portions 8 are each column-shaped, and axially extended from the other axial side surface of the stepped portion 5. A screw hole 8A for securing the guide duct 43 to the casing 2 using a bolt 44 is formed in the front end of the duct fixing portion 8.

Also, on one side in the lateral (radial) direction of the large-diameter cylinder portion 3 of the casing 2, there is formed an orbiting inlet 37 serving as an inlet port of an orbiting cooling passage 36 to be described later. On the other side in the lateral direction of the large-diameter cylinder portion 3 of the casing 2, there is formed an orbiting outlet 38 serving as an outlet port of the orbiting cooling passage 36.

In FIG. 2, reference numeral 9 denotes a fixed scroll provided at the opening 3A of the large-diameter cylinder portion 3 of the casing 2. The fixed scroll 9 is fixed to the opening 3A so as to close the opening 3A from one axial side. Also, the fixed scroll 9 is formed of metal, for example, metallic materials such as cast iron and aluminum. Furthermore, the fixed scroll 9 is generally composed of a disk-shaped plate body 9A, and a spiral fixed wrap 9B erected on a surface of the plate body 9A to be axially extended toward the casing 2. On the tip of the fixed wrap 9B, there is provided a tip seal 10 for sealing between the fixed wrap 9B and a plate body 17A of an orbiting scroll 17.

Reference numerals 11 denote two suction openings provided in upper and lower portions on the outer peripheral side of the fixed scroll 9. Each suction opening 11 communicates with an outermost compression chamber 23 among plural compression chambers 23 formed between the fixed scroll 9 and the orbiting scroll 17 as described later. Also, the suction openings 11 allow air to be compressed by the scroll air compressor 1 to flow into the respective outermost compression chambers 23 through respective inlet filters 12.

Reference numeral 13 denotes a discharge opening provided at the center of the plate body 9A of the fixed scroll 9. The discharge opening 13 communicates with the central compression chamber 23 of the plural compression chambers 23 to be described later. Also, the discharge opening 13 discharges the compressed air in this compression chamber 23 to an air tank (not shown) or the like, through a discharge pipe 14.

Figure 4:
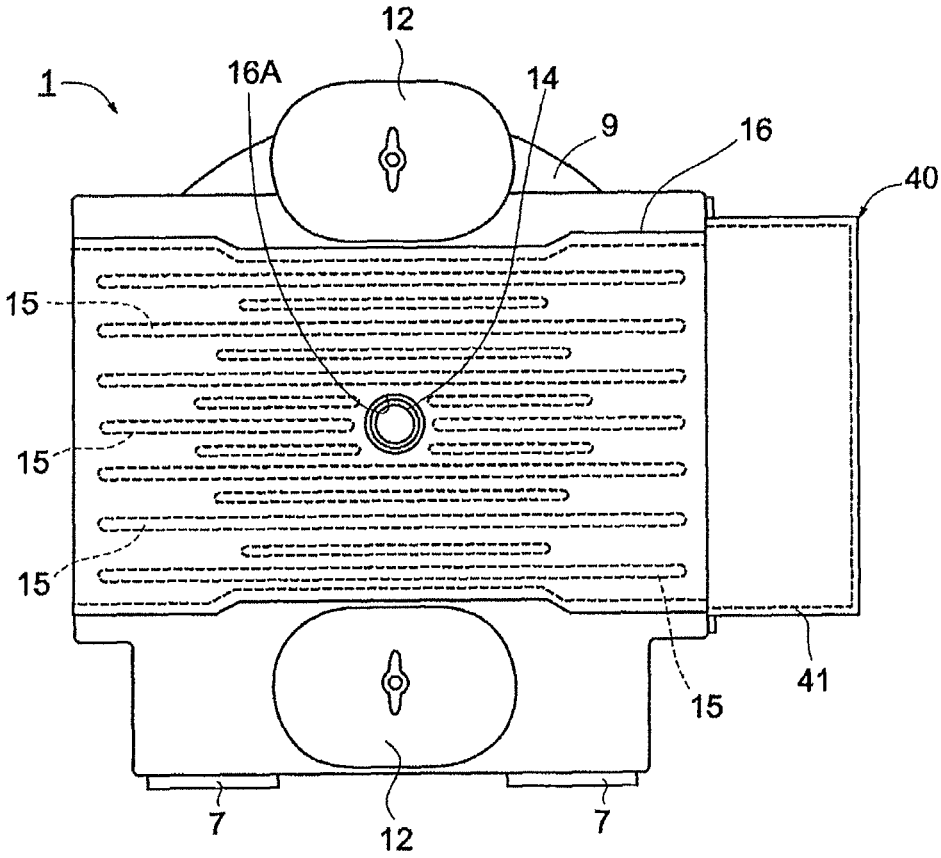
FIG. 4 is a front view of the scroll air compressor taken in the direction of arrow IV-IV of FIG. 2.

Reference numerals 15 denote plural fixed cooling fins provided at the rear of the fixed scroll 9. The fixed cooling fins 15 are erected at predetermined spacings on rear surfaces of the plate body 9A as shown in FIG. 2, and extend linearly, parallel to one another, from one end toward the other end in the radial (lateral) direction of the fixed scroll 9 as shown in FIG. 4. This structure prevents the flow of cooling air from being obstructed.

Reference numeral 16 denotes a cooling fin cover mounted on the rear of the fixed scroll 9. The cooling fin cover 16 surrounds the whole fixed cooling fin 15 as shown in FIG. 4, to thereby form a fixed cooling passage 32, to be described later, between the cooling fin cover 16 and the rear of the fixed scroll 9. Also, on one side in the lateral (radial) direction of the cooling fin cover 16, there is formed a fixed inlet 33, to be described later, serving as an inlet port of the fixed cooling passage 32. On the other side in the lateral direction of the cooling fin cover 16, there is formed a fixed outlet 34, to be described later, serving as an outlet port of the fixed cooling passage 32. In addition, a hole 16A through which the discharge pipe 14 passes, is formed in the center of the cooling fin cover 16.

It is to be noted that, in the case of a structure in which the outermost fixed cooling fins 15 of the plural fixed cooling fins 15 are exposed to the outside, the cooling fin cover 16 may be formed in a flat plate shape.

Furthermore, in FIG. 2, reference numeral 17 denotes an orbiting scroll provided in the casing 2. The orbiting scroll 17 is formed of metal, for example, metallic materials such as cast iron and aluminum. The orbiting scroll 17 is generally composed of a disk-shaped plate body 17A opposed to the plate body 9A of the fixed scroll 9, and a spiral orbiting wrap 17B erected on a surface of the plate body 17A. On the tip of the orbiting wrap 17B, there is provided a tip seal 18 for sealing between the orbiting wrap 17B and the plate body 9A of the fixed scroll 9.

Reference numerals 19 denote plural orbiting cooling fins provided at the rear of the orbiting scroll 17. The orbiting cooling fins 19 are erected at predetermined spacings on rear surfaces of the plate body 17A to extend linearly, parallel to one another, from one end toward the other end in the radial (lateral) direction of the orbiting scroll 17.

In this manner, since the orbiting cooling fins 19 and the fixed cooling fins 15 are oriented in the same direction, the flow in the same direction of cooling air allows efficient cooling.

Reference numeral 20 denotes a rear plate disposed at the front ends of the plural orbiting cooling fins 19 and fixed to the orbiting scroll 17. The rear plate 20 forms an orbiting cooling passage 36, to be described later, between the rear plate 20 and the rear of the orbiting scroll 17. Also, a cylindrical boss portion 21 rotatably connected to a crank 24A of a rotating shaft 24 to be described later is integrally formed at the center of the rear plate 20. In addition, on the outer peripheral side of the rear plate 20, there are provided bearing accommodating portions 22, for example, three, for each accommodating a bearing 28B of the auxiliary crank mechanism 28 to be described later. These bearing accommodating portions 22 are disposed at positions corresponding to the three bearing accommodating portions 6 provided on the stepped portion 5 of the casing 2.

Reference numerals 23 denote plural compression chambers formed between the fixed wrap 9B of the fixed scroll 9 and the orbiting wrap 17B of the orbiting scroll 17. When the orbiting scroll 17 performs an orbiting motion, the compression chambers 23 are successively contracted while moving from the outer peripheral side toward the center of the wraps 9B and 17B, thereby sucking air into the outermost compression chambers 23 among the compression chambers 23, through the suction openings 11. The sucked-in air is compressed to thereafter reach the central compression chamber 23. Finally, the compressed air is discharged from the discharge opening 13 to an external air tank (not shown), or the like, through the discharge pipe 14.

Reference numeral 24 denotes a rotating shaft 24 rotatably provided in the bushing 4 of the casing 2 through bearings 25 and 26. The rotating shaft 24 is driven by a motor (not shown) to rotate, thereby allowing the orbiting scroll 17 to perform an orbiting motion and rotating a centrifugal fan 30 to be described later. More specifically, on one end of the rotating shaft 24, there is provided a crank 24A with its axis radially eccentric relative to the axis of the rotating shaft 24 by a certain distance. The crank 24A is rotatably connected (engaged), through an orbiting bearing 27, with the boss portion 21 provided on the rear plate 20 of the orbiting scroll 17. The other end of the rotating shaft 24 protrudes outward from the opening 4A of the bushing 4 of the casing 2.

Reference numeral 28 denotes an auxiliary crank mechanism provided between the rear plate 20 and the stepped portion 5 of the casing 2. The auxiliary crank mechanism 28 is composed of a bearing 28A accommodated in the bearing accommodating portion 6 provided on the stepped portion 5, a bearing 28B accommodated in the bearing accommodating portion 22 provided on the rear plate 20, and an auxiliary crank 28C rotatably attached to the bearings 28A and 28B. The auxiliary crank mechanisms 28, for example, three, are disposed evenly spaced apart from one another in a circumferential direction. Also, these auxiliary crank mechanisms 28 prevent the orbiting scroll 17 from rotating on its axis in the casing 2 during the orbiting motion thereof.

Reference numeral 29 denotes a pulley fixed to the other end of the rotating shaft 24 to be rotatable with the rotating shaft 24. The pulley 29 is connected to an output shaft of the motor through a belt (not shown) to transmit rotation of the output shaft of the motor to the rotating shaft 24.

Reference numeral 30 denotes a discharging centrifugal fan provided on the other end of the rotating shaft 24. The centrifugal fan 30 is a so-called sirocco fan including a disk-shaped bottom plate 30A and plural blades 30B provided in cylindrical shapes extending axially from the outer peripheral side of the bottom plate 30A to one side. The other end of the rotating shaft 24 is allowed to pass through a through-hole 30C formed in the center of the bottom plate 30A. Also, the centrifugal fan 30 is fixed to the pulley 29 using screws 31 to rotate with the pulley 29 and the rotating shaft 24, thereby creating the flow of cooling air as shown by arrows A to H of FIG. 3. It is to be noted that the centrifugal fan 30 is not limited to the sirocco fan, but also can be a turbofan.

In FIG. 3, reference numeral 32 denotes a fixed cooling passage provided at the rear of the fixed scroll 9. The fixed cooling passage 32 is composed of a fixed inlet 33 located on one radial side of the fixed scroll 9, a fixed outlet 34 located on the other radial side of the fixed scroll 9, and a flow path 35 connecting between the fixed inlet 33 and the fixed outlet 34.

More specifically, the fixed inlet 33 is formed on one side in the lateral direction of the cooling fin cover 16, and the fixed outlet 34 is formed on the other side in the lateral direction of the cooling fin cover 16. Also, the flow path 35 connecting between the fixed inlet 33 and the fixed outlet 34 is formed between the plural fixed cooling fins 15 provided between the cooling fin cover 16 and the rear of the fixed scroll 9, as shown in FIG. 3.

On the other hand, in FIG. 3, reference numeral 36 denotes an orbiting cooling passage provided at the rear of the orbiting scroll 17. The orbiting cooling passage 36 is composed of an orbiting inlet 37 located on one radial side of the orbiting scroll 17, an orbiting outlet 38 located on the other radial side of the orbiting scroll 17, and a flow path 39 connecting between the orbiting inlet 37 and the orbiting outlet 38.

More specifically, the orbiting inlet 37 is formed on one side in the lateral direction of the large-diameter cylinder portion 3 of the casing 2. Also, the orbiting inlet 37 is disposed side-by-side with and adjacent to the fixed inlet 33, and the orbiting inlet 37 and the fixed inlet 33 are opened in such a manner as to be oriented in the same direction. The orbiting outlet 38 is formed opposite the orbiting inlet 37 on the other side in the lateral direction of the large-diameter cylinder portion 3 of the casing 2. Also, the orbiting outlet 38 is disposed side-by-side with and adjacent to the fixed outlet 34, and the orbiting outlet 38 and the fixed outlet 34 are opened in such a manner as to be oriented in the same direction. The flow path 39 connecting between the orbiting inlet 37 and the orbiting outlet 38 is formed between the plural orbiting cooling fins 19 provided between the orbiting scroll 17 and the rear plate 20, as shown in FIG. 3.

In FIG. 1 or 3, reference numeral 40 denotes a cooling duct serving as a cooling air passage with one end communicating with the fixed outlet 34 and the orbiting outlet 38 and the other end communicating with the inner peripheral side of the centrifugal fan 30 through the outer periphery of the other end of the casing 2. The cooling duct 40 is composed of a side duct 41 and a guide duct 43 to be described later.

Reference numeral 41 denotes a side duct having one end communicating with the fixed outlet 34 and the orbiting outlet 38, and surrounding one side surface of the large-diameter cylinder portion 3 of the casing 2. The side duct 41 is formed of resin, for example, resin materials such as polypropylene (PP), ABS resin, nylon, and polybutylene terephthalate (PBT). More specifically, the side duct 41 is attached, using bolts 42, to a side surface of the other side in the lateral direction of the large-diameter cylinder portion 3 of the casing 2, as shown in FIG. 1. Also, as shown in FIG. 3, the side duct 41 generally covers, from the side, both the fixed outlet 34 and the orbiting outlet 38, however on the other hand, is opened on the other axial side to communicate with the guide duct 43. With this structure, cooling air entering through the fixed inlet 33 and the orbiting inlet 37 as shown by arrows A and B, flows out from the fixed outlet 34 and the orbiting outlet 38 to the other side in the lateral direction, and thereafter makes 90-degree turns so as to be directed to the other axial side as shown by arrows C and D to be guided by the guide duct 43 to be described later.

Reference numeral 43 denotes a guide duct communicating with the side duct 41 and surrounding the outer periphery of the bushing 4 provided on the other end of the casing 2. The guide duct 43 is formed of resin, for example, resin materials such as polypropylene (PP), ABS resin, nylon, and polybutylene terephthalate (PBT). More specifically, the guide duct 43 is formed into a cylinder, and, as shown in FIG. 5, surrounds the whole periphery of the bushing 4 of the casing 2 to form a closed annular space between the guide duct 43 and the outer peripheral surface of the bushing 4.

Figure 5:
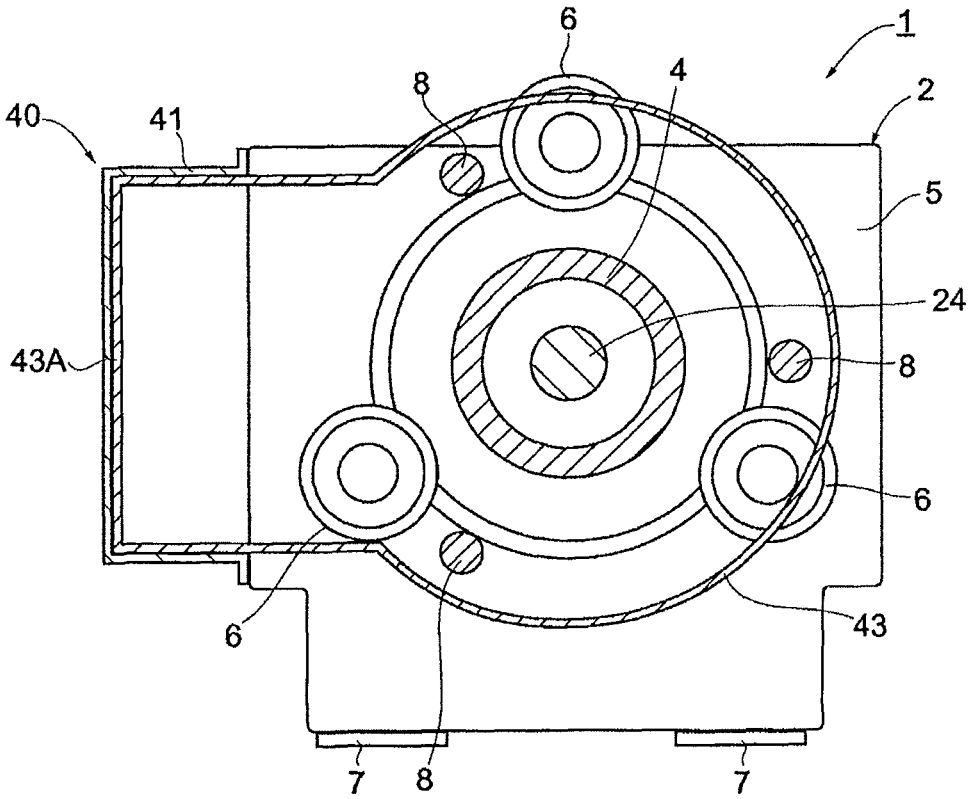
FIG. 5 is a cross-sectional view of the scroll air compressor taken in the direction of arrow V-V of FIG. 3.

As shown in FIGS. 3 and 5, a peripheral wall 43A located on the other side in the lateral direction of the guide duct 43, protrudes outward in the lateral direction. Also, the inside of the side duct 41 and the annular space within the guide duct 43 communicate with each other through the peripheral wall 43A. Thus, cooling air flowing from the fixed outlet 34 and the orbiting outlet 38 through the side duct 41, is guided to the annular space within the guide duct 43 through the peripheral wall 43A.

Also, a base 43B is formed on the other axial end of the guide duct 43, and the inner peripheral side of the base 43B serves as an opening 43C. Through the opening 43C, the annular space within the guide duct 43, and the inside of a fan cover 45 to be described later, communicate with each other.

Further, a cylindrical guide portion 43D gradually reduced in diameter toward the other axial side, is formed at the edge of the opening 43C. The front end of the guide portion 43D reaches the inner peripheral side of the centrifugal fan 30. The guide portion 43D allows an inner surface of the guide duct 43 to gradually approach an outer peripheral surface of the bushing 4 of the casing 2, so that the annular space within the guide duct 43 is gradually reduced in size toward the inner peripheral side of the centrifugal fan 30. Thus, as shown by arrows F and G, the cooling air guided into the guide duct 43 is gathered in the vicinity of the outer peripheral surface of the bushing 4 of the casing 2 by the guide portion 43D to be smoothly sucked into the inner peripheral side of the centrifugal fan 30.

Figure 6:
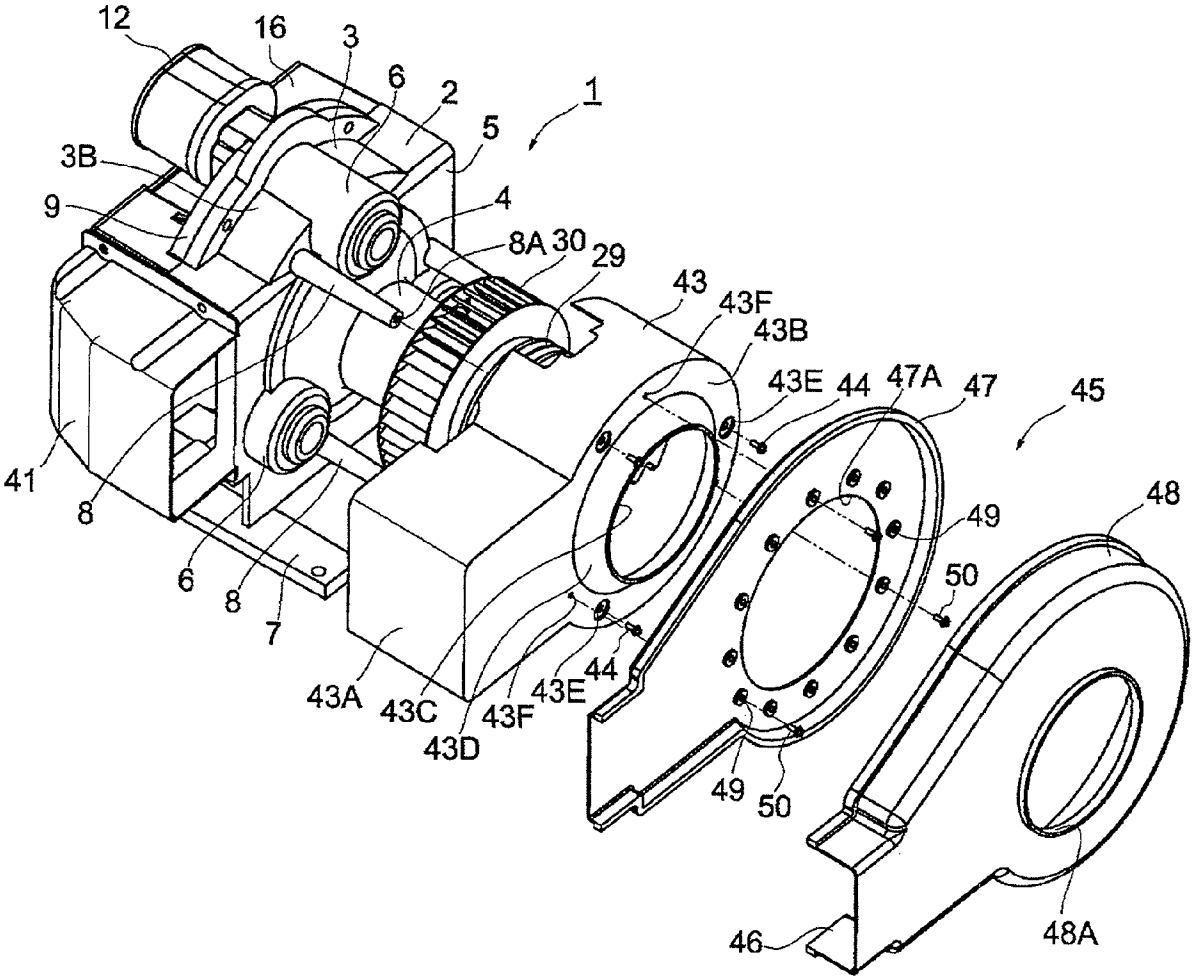
FIG. 6 is a perspective view, with a guide duct and a fan cover disassembled, of the scroll air compressor.
Figure 7:
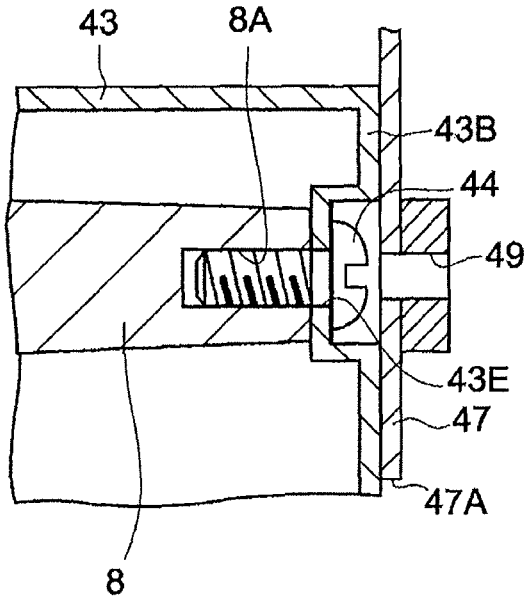
FIG. 7 is an enlarged longitudinal sectional view illustrating an attaching mechanism of a casing and the guide duct.

Also, as shown in FIG. 6, for example, three bolt through-holes 43E are formed in the base 43B of the guide duct 43. The bolt through-holes 43E are disposed spaced apart from one another in a circumferential direction so as to correspond to the screw holes 8A formed in the front ends of the duct fixing portions 8 provided on the casing 2. When attaching the guide duct 43 to the casing 2, the guide duct 43 is secured to the casing 2 by fastening bolts 44 into the screw holes 8A of the duct fixing portions 8 through the bolt through-holes 43E as shown in FIG. 7. Here, FIG. 6 is an exploded view of only the guide duct 43 and a fan cover 45 of the essential parts of the present invention, for descriptive purposes. Note that, in an actually assembled state, the centrifugal fan 30 is disposed between a mounting plate 47 and a cover portion 48 to be described later.

In addition, as shown in FIG. 6, for example, three screw holes 43F are formed in the base 43B of the guide duct 43. These screw holes 43F are evenly spaced, for example, 120 degrees apart from one another in a circumferential direction. In the first embodiment, these screw holes 43F are disposed in the same periphery as the bolt through-holes 43E.

In FIG. 1, 3 or 6, reference numeral 45 denotes a fan cover. The fan cover 45 surrounds the centrifugal fan 30, with an inner peripheral portion thereof connected to the other end of the cooling duct 40 (the guide duct 43) and with an outer peripheral portion thereof having an exhaust port 46 for discharging the cooling air coming from the centrifugal fan 30. Also, the fan cover 45 is formed of resin, for example, resin materials such as polypropylene (PP), ABS resin, nylon, and polybutylene terephthalate (PBT). More specifically, the fan cover 45 is formed into a hollow cylindrical housing by joining together a mounting plate 47 and a cover portion 48 each formed in a based generally cylindrical shape, with respective openings thereof facing each other, and contains the centrifugal fan 30. Also, the other end of the bushing 4 of the casing 2, the other end of the rotating shaft 24, and the guide portion 43D of the guide duct 43, are inserted into a suction port 47A formed in the center of the mounting plate 47. On the other hand, the other end of the rotating shaft 24 and the pulley 29 are inserted into a through-hole 48A formed in the center of the cover portion 48.

Also, a portion of the other side in the lateral direction of the fan cover 45 protrudes outward in the lateral direction, and the exhaust port 46 is formed at the front end thereof. Thus, the cooling air sucked into the inner peripheral side of the centrifugal fan 30 through the guide portion 43D of the guide duct 43, is discharged from the exhaust port 46 to the outside as shown by arrow H of FIG. 3.

Figure 8:
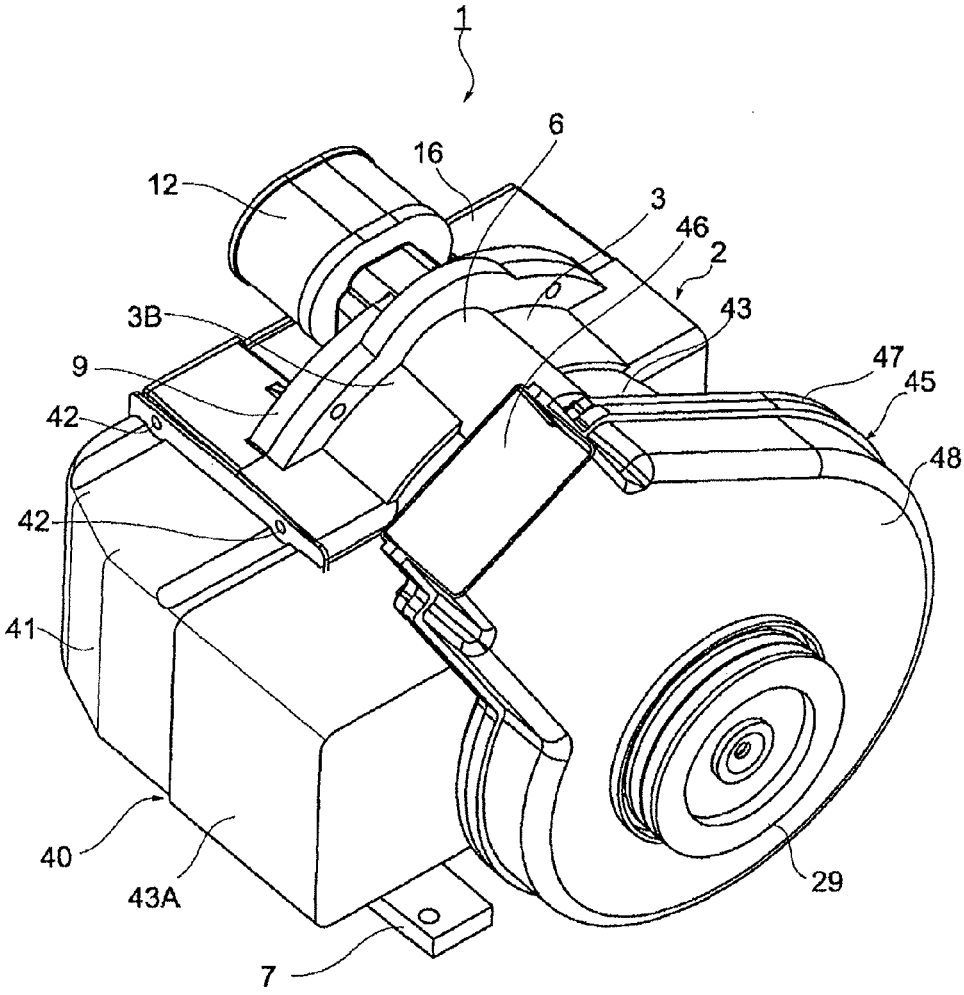
FIG. 8 is a perspective view, with the fan cover mounted in such a manner that an exhaust port faces upward, of the scroll air compressor according to the first embodiment of the present invention.

Further, as shown in FIG. 6, for example, twelve bolt through-holes 49 are formed in the mounting plate 47 of the fan cover 45. These bolt through-holes 49 are evenly spaced, for example, 30 degrees apart from one another in a circumferential direction so as to surround the suction port 47A. Among the twelve bolt through-holes 49, the three bolt through-holes 49 disposed 120 degrees apart from one another, correspond to the three screw holes 43F formed in the base 43B of the guide duct 43. When attaching the mounting plate 47 to the guide duct 43, the fan cover 45 is secured to the guide duct 43 by arbitrarily selecting three bolt through-holes 49 disposed 120 degrees apart from one another from among the twelve bolt through-holes 49, and then fastening bolts 50 into the screw holes 43F of the guide duct 43 through these selected bolt through-holes 49. The mounting angle of the fan cover 45 with respect to the guide duct 43 can be varied every 30 degrees according to the three bolt through-holes 49, disposed 120 degrees apart from one another, to be selected from among the twelve bolt through-holes 49. Thus, the exhaust port 46 can be turned every 30 degrees. For example, the exhaust port 46 may be transversely provided as shown in FIG. 1, or alternatively can be in an obliquely upward direction as shown in FIG. 8.

The scroll air compressor 1 according to the first embodiment 1 includes the above-described structure, and next, its air-compression operation will be described.

In short, in the scroll air compressor 1, the motor is driven so as to rotate the rotating shaft 24 and to allow the orbiting scroll 17 to perform an orbiting motion, thereby sucking in air through the suction openings 11, and the sucked-in air is compressed in the respective compression chambers 23. Also, the high-pressure compressed air is discharged from the discharge opening 13 to an air tank or the like.

Next, the cooling operation of the scroll air compressor 1 according to the first embodiment will be described.

In short, during the air-compression operation of the scroll air compressor 1 as described above, the centrifugal fan 30 rotates with the rotating shaft 24, thereby causing a flow of the cooling air as shown by arrows A to H of FIG. 3. More specifically, outside air flows from the fixed inlet 33 into the flow path 35 located at the rear of the fixed scroll 9, as shown by arrow A. Thereafter, the air functions as the cooling air and flows through between the respective fixed cooling fins 15 to draw heat from the fixed cooling fins 15, thereby cooling the fixed scroll 9. At the same time, outside air flows from the orbiting inlet 37 into the flow path 39 located at the rear of the orbiting scroll 17, as shown by arrow B. Thereafter, the air functions as the cooling air and flows through between the respective orbiting cooling fins 19 to draw heat from the respective orbiting cooling fins 19, thereby cooling the orbiting scroll 17.

The cooling air cools the fixed scroll 9 and the orbiting scroll 17 in this manner, and thereafter flows out from the fixed outlet 34 and the orbiting outlet 38. At this time, the temperature of the cooling air flowing out of the fixed outlet 34 and the orbiting outlet 38, is higher than outside air due to heat of the fixed scroll 9 and the orbiting scroll 17.

And then, the respective cooling airs flowing out from the fixed outlet 34 and the orbiting outlet 38 are merged while being turned 90 degrees by the side duct 41 as shown by arrows C and D to be guided into the guide duct 43 as shown by arrow E.

Subsequently, the cooling air flowing into the guide duct 43 is blown onto an outer peripheral surface of the bushing 4 of the casing 2 to thereby adjust the temperature of the bushing 4. Also, since the cooling air flowing into the guide duct 43 hits rear surfaces of the respective bearing accommodating portions 6 formed on the stepped portion 5 of the casing 2, a temperature regulating effect on the respective auxiliary crank mechanisms 28 is also exerted. In other words, as described above, the temperature of the cooling air flowing out of the fixed outlet 34 and the orbiting outlet 38 is higher than outside air. This cooling air increased in temperature is guided to the outer periphery of the bushing 4 of the casing 2 through the side duct 41 and the guide duct 43 to be blown onto the outer peripheral surface of the bushing 4, and the rear surfaces of the respective bearing accommodating portions 6, thereby making the adjustment to nearly equalize the temperatures of the bushing 4 and the respective bearing accommodating portions 6, and the temperature of the orbiting scroll 17.

Thereafter, the cooling air passes through the annular space formed between the inner peripheral surface of the guide portion 43D and the bushing 4 to be guided to the inner peripheral side of the centrifugal fan 30, as shown by arrows F and G. Finally, the cooling air is discharged from the exhaust port 46 to the outside by rotation of the centrifugal fan 30, as shown by arrow H.

As described above, the scroll air compressor 1 according to the first embodiment includes a structure in which the cooling air flowing out of the fixed outlet 34 through the flow path 35 of the fixed cooling passage 32 provided at the rear of the fixed scroll 9, and the cooling air flowing out of the orbiting outlet 38 through the flow path 39 of the orbiting cooling passage 36 provided at the rear of the orbiting scroll 17, are guided to the inner peripheral side of the centrifugal fan 30 through the outer periphery of the other end of the casing 2 by the side duct 41 and the guide duct 43, and then discharged outwardly from the exhaust port 46 provided in the fan cover 45 by the centrifugal fan 30. With this structure, it is possible to enhance a cooling effect of the scroll air compressor 1.

In other words, outside air is directly sucked in through the fixed inlet 33, and then the air, functioning as cooling air, is allowed to flow into the rear of the fixed scroll 9, thereby allowing a reduction of the air-blast resistance of the cooling air and an increase in quantity of the cooling air. Also, the fixed scroll 9 can be cooled by low-temperature fresh air for first use in cooling thereof instead of using high-temperature air after use for cooling other members. Therefore, the cooling effect of the fixed scroll 9 can be enhanced. In the same manner, outside air is directly sucked in through the orbiting inlet 37, and then the air, functioning as cooling air, is allowed to flow into the rear of the orbiting scroll 17. Therefore, the cooling effect of the orbiting scroll 17 can be enhanced.

Meanwhile, the cooling air flowing out of the fixed outlet 34 and the orbiting outlet 38 is allowed to flow to the inner peripheral side of the centrifugal fan 30 through the outer periphery of the other end of the casing 2 by the side duct 41 and the guide duct 43. Thus, it is possible to reduce temperature differences between the orbiting scroll 17 and the other end (the bushing 4) of the casing 2, and avoid damage, or the like, to the bearings 28A and 28B caused by pitch differentials of the auxiliary crank 28C. That is to say, the cooling air increased in temperature relative to outside air due to heat from the fixed scroll 9 and the orbiting scroll 17, is blown onto an outer peripheral surface, or the like, of the other end of the casing 2, thereby allowing equalization of the temperature of the other end of the casing 2 and the orbiting scroll 17, and reduction of temperature differences between both sides in the axial direction of the auxiliary crank 28C mounted between the casing 2 and the orbit scroll 17. Thus, it is possible to suppress deformation of the auxiliary crank 28C caused by differences of temperature, and avoid damage, or the like, to the bearings 28A and 28B caused by pitch differentials of the auxiliary crank 28C.

In particular, in the scroll air compressor 1 according to the first embodiment, the guide duct 43 is provided over the whole periphery of the other end (the bushing 4) of the casing 2. This allows the cooling air flowing out of the fixed outlet 34 and the orbiting outlet 38 to hit the whole periphery of the outer peripheral surface of the other end of the casing 2. Therefore, it is possible to equalize the temperature of the whole periphery of the other side of the casing 2 and the temperature of the orbiting scroll 17, and effectively avoid damage, or the like, to the bearings 28A and 28B caused by pitch differentials of the auxiliary crank 28C.

Furthermore, the scroll air compressor 1 according to the first embodiment of the present invention can be miniaturized, as compared with the related art scroll fluid machine disclosed in Japanese Published Unexamined Utility Model Application No. Hei 5-78988. More specifically, the related art scroll fluid machine disclosed in the above-identified patent literature adopts such a large cooling duct as to totally surround a scroll fluid machine main body so as to allow cooling air to flow through an outer peripheral space of a fixed scroll and an outer peripheral space of a casing. However, according to the scroll air compressor 1 according to the first embodiment of the present invention, the cooling air is allowed to flow through the fixed cooling passage 32 provided at the rear of the fixed scroll 9, and the orbiting cooling passage 36 provided at the rear of the orbiting scroll 17 disposed in the casing 2, and thereafter guided to the inner peripheral side of the centrifugal fan 30 through the outer periphery of the other end of the casing 2. With this structure, such a large cooling duct as to totally surround the scroll air compressor 1 becomes unnecessary, and therefore, the scroll air compressor 1 can be miniaturized.

In particular, the scroll air compressor 1 includes a structure in which a portion of the lateral surface of one axial end of the casing 2, more specifically, a portion 3B on at least the upper side of the lateral surface of the large-diameter cylinder portion 3 of the casing 2, is exposed to the outside (see FIG. 1). That is to say, unlike the related art scroll fluid machine in which the casing is totally surrounded from right to left and up and down by the cooling duct, the scroll air compressor 1 according to the first embodiment of the present invention is constructed with the casing 2 partially exposed to the outside. Therefore, the small scroll air compressor 1 can be realized.

Also, the scroll air compressor 1 according to the first embodiment includes a structure in which the fixed inlet 33 is disposed side-by-side with the orbiting inlet 37 so that the fixed inlet 33 and the orbiting inlet 37 are oriented in the same direction, and in which the fixed outlet 34 is disposed side-by-side with the orbiting outlet 38 so that the fixed outlet 34 and the orbiting outlet 38 are oriented in the same direction. With this structure, it is possible to suppress quantity variations between the cooling air flowing through the fixed cooling passage 32 provided at the rear of the fixed scroll 9 to flow out from the fixed outlet 34, and the cooling air flowing through the orbiting cooling passage 36 provided at the rear of the orbiting scroll 17, and ensure balanced cooling of the fixed scroll 9 and the orbiting scroll 17.

Furthermore, in the scroll air compressor 1 according to the first embodiment, the direction of the exhaust port 46 can be changed by varying the mounting angle of the fan cover 45 (see FIGS. 1 and 8). Thus, it is possible to arbitrarily set the discharge direction of the cooling air, and increase the layout freedom when installing the scroll air compressor 1 in a package (a soundproof box) for a soundproof structure. In particular, according to the first embodiment, the exhaust port 46 can be turned over 360 degrees, and the direction of the exhaust port 46 can be set in any direction, such as vertically or horizontally.

In addition, the scroll air compressor 1 according to the first embodiment includes a structure in which the suction port 47A serving as a direct cooling air suction port for the centrifugal fan 30 is totally surrounded by the guide duct 43 and the fan cover 45. With this structure, it is possible to suppress noise of the centrifugal fan 30 leaking outward through the suction port 47A. In other words, in another scroll fluid machine according to the related art, the outer periphery of the other end of a casing is exposed to the outside, and outside air is sucked in therefrom by a centrifugal fan. In such another scroll fluid machine according to the related art, an air suction port is opened outward at the outer periphery of the other end of the casing, and therefore, noise, such as wind noise, of the centrifugal fan leaks outward through the suction port. However, in the scroll air compressor 1 according to the first embodiment, the suction port 47A located at the outer periphery of the other end of the casing 2, is totally surrounded by the guide duct 43 and the fan cover 45, thereby allowing a reduction of noise, such as wind noise, of the centrifugal fan 30 leaking outward through the suction port 47A.

Moreover, in the scroll air compressor 1 according to the first embodiment, the casing 2, the fixed scroll 9, and the orbiting scroll 17 are formed of metal, thereby allowing an increase in strength of the scroll air compressor 1. Also, the cooling duct 40 (at least the guide duct 43) and the fan cover 45 are made of resin, thereby allowing a reduction in weight of the scroll air compressor 1.

In the above-described first embodiment, the scroll air compressor 1 in which the side duct 41, the guide duct 43, and the fan cover 45 are formed of resin materials, is provided by way of example, however, the present invention is not limited to this embodiment. For example, any or all of the side duct 41, the guide duct 43, and the fan cover 45 may be formed of metallic materials such as aluminum.

Also, according to the above-described scroll air compressor 1, from among the twelve bolt through-holes 49 formed in the mounting plate 47, three bolt through-holes 49 are arbitrarily selected, and then the bolts 50 are fastened through these selected bolt through-holes 49. In this manner, the scroll air compressor 1 is constructed so that the direction of the exhaust port 46 is changed by varying the mounting angle of the fan cover 45. However, the present invention is not limited to this structure. For example, elongated holes, e.g., four, extending in a circumferential direction may be formed, for example, 90 degrees apart from one another on the periphery of the suction port 47A of the mounting plate 47. This structure allows fine adjustment of the direction of the exhaust port 46, and an increase in the freedom of direction setting.

Second Embodiment

Next, a second embodiment of the present invention will be described with reference to FIGS. 9 and 10. In the second embodiment shown in FIGS. 9 and 10, the same elements as those in the above-described first embodiment shown in FIGS. 1 to 8 are designated by the same reference numerals as those described above, and the descriptions thereof will not be repeated.

Figure 9:
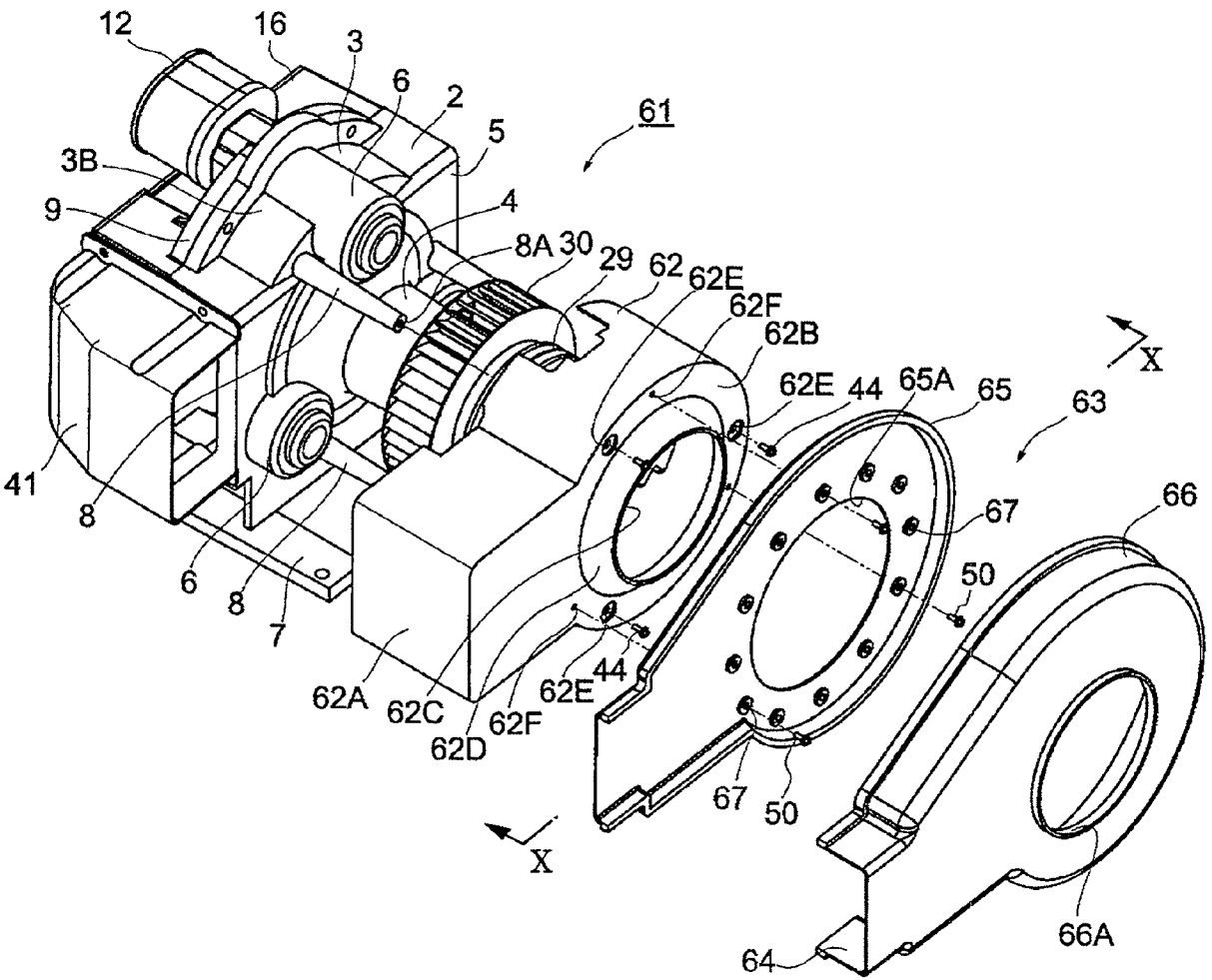
FIG. 9 is a perspective view, with a guide duct and a fan cover disassembled, of a scroll air compressor according to a second embodiment of the present invention.

In FIG. 9, reference numeral 61 denotes a scroll air compressor according to the second embodiment of the present invention. Also, reference numeral 62 denotes a resin guide duct, communicating with the side duct 41 provided on one side surface of the large-diameter cylinder portion 3 of the casing 2, and surrounding the outer periphery (the bushing 4) of the other end of the casing 2. The guide duct 62 is formed into a cylinder, and surrounds the whole periphery of the bushing 4 of the casing 2, in the same manner as the guide duct 43 according to the above-described first embodiment. Also, a peripheral wall 62A is provided on the other side in the lateral direction of the guide duct 62, and a base 62B is formed on the other axial end of the guide duct 62. Also, the inner peripheral side of the base 62B is provided with an opening 62C. Further, a guide portion 62D is formed on the edge of the opening 62C. Here, FIG. 9 is an exploded view of only the guide duct 62 and a fan cover 63 of the essential parts of the present invention, for descriptive purposes. Note that, in an actually assembled state, the centrifugal fan 30 is disposed between a mounting plate 65 and a cover portion 66 to be described later.

In addition, bolt through-holes 62E, for example, three, are formed in the base 62B of the guide duct 62, as shown in FIG. 9. These bolt through-holes 62E are disposed spaced apart in a circle C1 having a diameter D1, as shown in FIG. 10. The respective bolt through-holes 62E are disposed so as to correspond to the screw holes 8A formed in the front ends of the duct fixing portions 8 provided on the casing 2. When attaching the guide duct 62 to the casing 2, the guide duct 62 is secured to the casing 2 by fastening bolts 44 into the screw holes 8A of the duct fixing portions 8 through the bolt through-holes 62E as shown in FIG. 9.

In addition, three screw holes 62F, for example, three, are formed in the base 62B of the guide duct 62, as shown in FIG. 9. These screw holes 62F are evenly spaced, for example, 120 degrees apart in a circle C2 having a diameter D2 larger than that of the circle C1, as shown in FIG. 10.

In FIG. 9, reference numeral 63 denotes a resin fan cover, surrounding the centrifugal fan 30, with an inner peripheral portion connected to the other end of the guide duct 62 and with an outer peripheral portion having an exhaust port 64 for discharging the cooling air coming from the centrifugal fan 30. The fan cover 63 is formed into a hollow cylindrical housing by joining together a mounting plate 65 and a cover portion 66 each formed in a based generally cylindrical shape, with respective openings thereof facing each other. Also, the mounting plate 65 includes a suction port 65A in the same manner as the mounting plate 47 according to the first embodiment, and the cover portion 66 includes a through-hole 66A in the same manner as the cover portion 48 according to the first embodiment.

Figure 10:
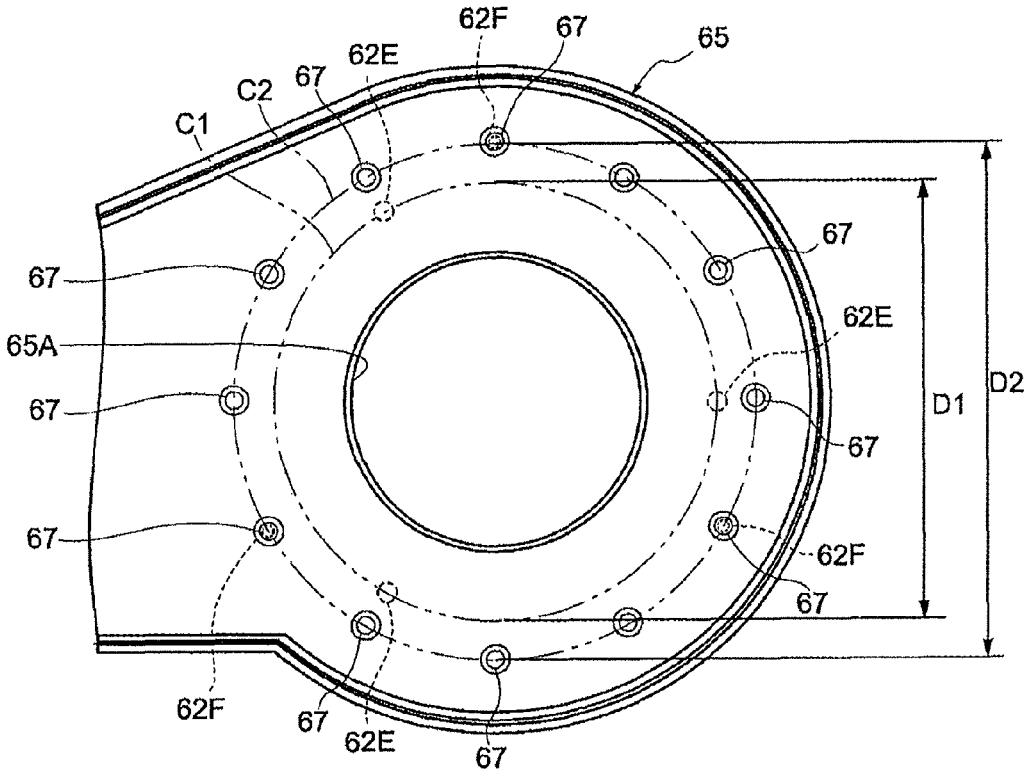
FIG. 10 is a plan view of a mounting plate of the fan cover, taken in the direction of arrow X-X of FIG. 9.

Further, bolt through-holes 67, for example, twelve, are formed in the mounting plate 65, as shown in FIG. 10. These bolt through-holes 67 are evenly spaced, for example, 30 degrees apart from one another in a circumferential direction so as to surround the suction port 65A. Also, these bolt through-holes 67 are disposed in the circle C2 having the diameter D2. Among the twelve bolt through-holes 67, the three bolt through-holes 67 disposed 120 degrees apart from one another correspond to the three screw holes 62F formed in the base 62B of the guide duct 62.

When attaching the mounting plate 65 of the fan cover 63 to the guide duct 62, the mounting plate 65 is secured to the guide duct 62 by arbitrarily selecting three bolt through-holes 67 disposed 120 degrees apart from one another from among the twelve bolt through-holes 67 and then fastening the bolts 50 into the screw holes 62F of the guide duct 62 through these selected bolt through-holes 67. The mounting angle of the fan cover 63 with respect to the guide duct 62 can be varied every 30 degrees according to the three bolt through-holes 67, disposed 120 degrees apart from one another, to be selected from among the twelve bolt through-holes 67. Thus, the exhaust port 64 can be turned every 30 degrees.

According to the scroll air compressor 61 according to the second embodiment of the present invention including the above-identified structure, therefore, advantageous effects similar to those in the scroll air compressor 1 according to the first embodiment as described above can be obtained.

Further, in the scroll air compressor 61 according to the second embodiment, the screw holes 8A and the bolt through-holes 62E for fastening the bolts 44 for securing the guide duct 62 to the casing 2 are disposed in the circle C1. On the other hand, the screw holes 62F and the bolt through-holes 67 for fastening the bolts 50 for securing the mounting plate 65 of the fan cover 63 to the guide duct 62 are disposed in the circle C2 having a diameter different from the circle C1. With this structure, it is possible to prevent incorrect mounting of the mounting plate 65 of the fan cover 63 with respect to the guide duct 62.

That is to say, the positions of the three bolt through-holes 62E disposed in the circle C1 do not correspond to the positions of any three bolt through-holes 67 disposed 120 degrees apart in the circle C2. Therefore, when attaching the mounting plate 65 of the fan cover 63 to the guide duct 62, it is possible to prevent the bolts 50 from being incorrectly inserted into the bolt through-holes 62E or incorrectly fastened into the screw holes 8A, instead of fastening the bolts 50 into the screw holes 62F through the bolt through-holes 67.

Third Embodiment

Next, a third embodiment of the present invention will be described with reference to FIG. 11. In the third embodiment shown in FIG. 11, the same elements as those in the above-described first embodiment shown in FIGS. 1 to 8 are designated by the same reference numerals as those described above, and the descriptions thereof will not be repeated.

Figure 11:
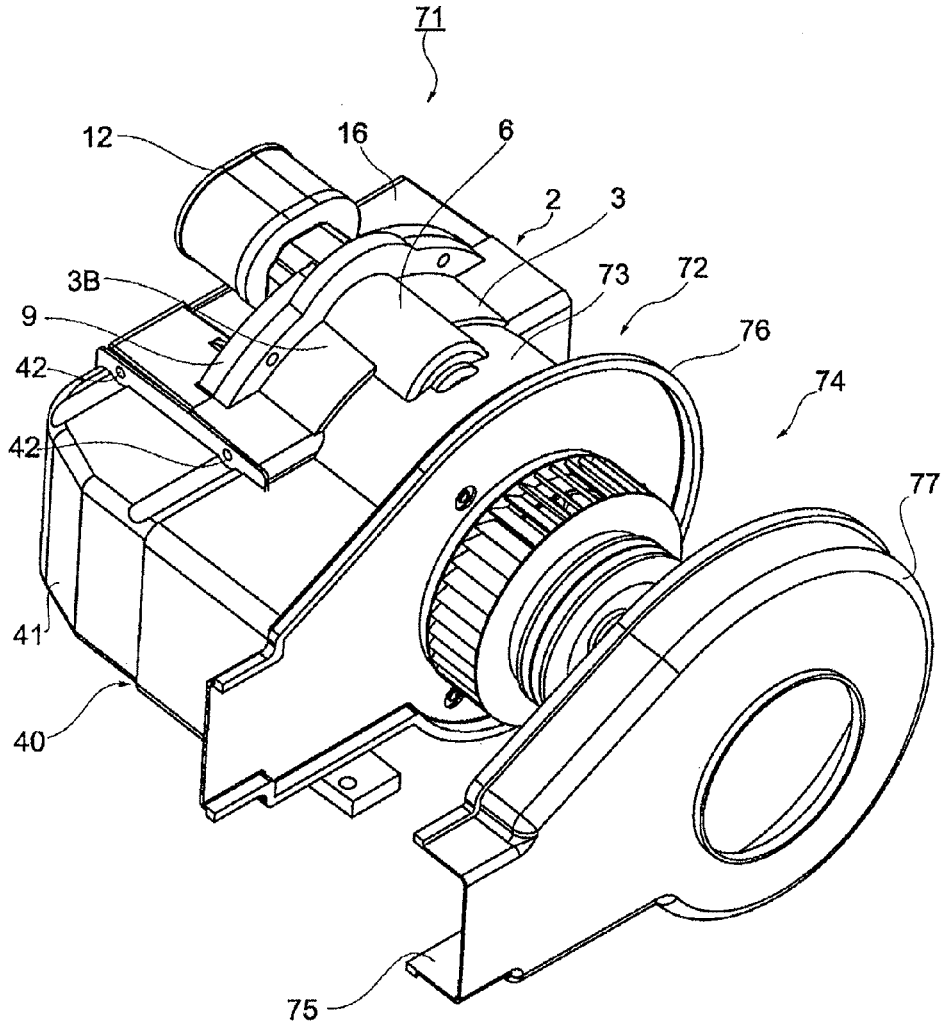
FIG. 11 is a perspective view of a scroll air compressor according to a third embodiment of the present invention.

In FIG. 11, reference numeral 71 denotes a scroll air compressor according to the third embodiment of the present invention. Also, reference numeral 72 is a resin duct unit. The duct unit 72 is composed of an integrated combination of a guide duct 73 communicating with the side duct 41 and surrounding the outer periphery of the bushing 4 provided on the other end of the casing 2, and a fan cover 74 surrounding the centrifugal fan 30, with an inner peripheral portion connected to the other end of the guide duct 73 and with an outer peripheral portion having an exhaust port 75 for discharging the cooling air coming from the centrifugal fan 30. In other words, the guide duct 73 and the fan cover 74 include the structure similar to the guide duct 43 and the fan cover 45 according to the first embodiment, however, a mounting plate 76 of the fan cover 74 is previously fixedly secured to the other axial side of the guide duct 73 with adhesives. Here, a cover portion 77 of the fan cover 74 is the same as the cover portion 48 according to the first embodiment.

According to the scroll air compressor 71 according to the third embodiment of the present invention including the above-identified structure, therefore, advantageous effects similar to those in the scroll air compressor 1 according to the first embodiment of the present invention as described above can be also obtained.

In addition, in the scroll air compressor 71 according to the third embodiment, since the guide duct 73 and the mounting plate 76 of the fan cover 74 is integrated, the number of components or the production costs of the scroll air compressor 71 can be reduced.

Alternatively, the duct unit 72 described above can be formed as a single resin-formed component with the guide duct 73 and the mounting plate 76 integrated.

Fourth Embodiment

Next, a fourth embodiment of the present invention will be described with reference to FIG. 12. In the fourth embodiment shown in FIG. 12, the same elements as those in the above-described first embodiment shown in FIGS. 1 to 8 are designated by the same reference numerals as those described above, and the descriptions thereof will not be repeated.

Figure 12:
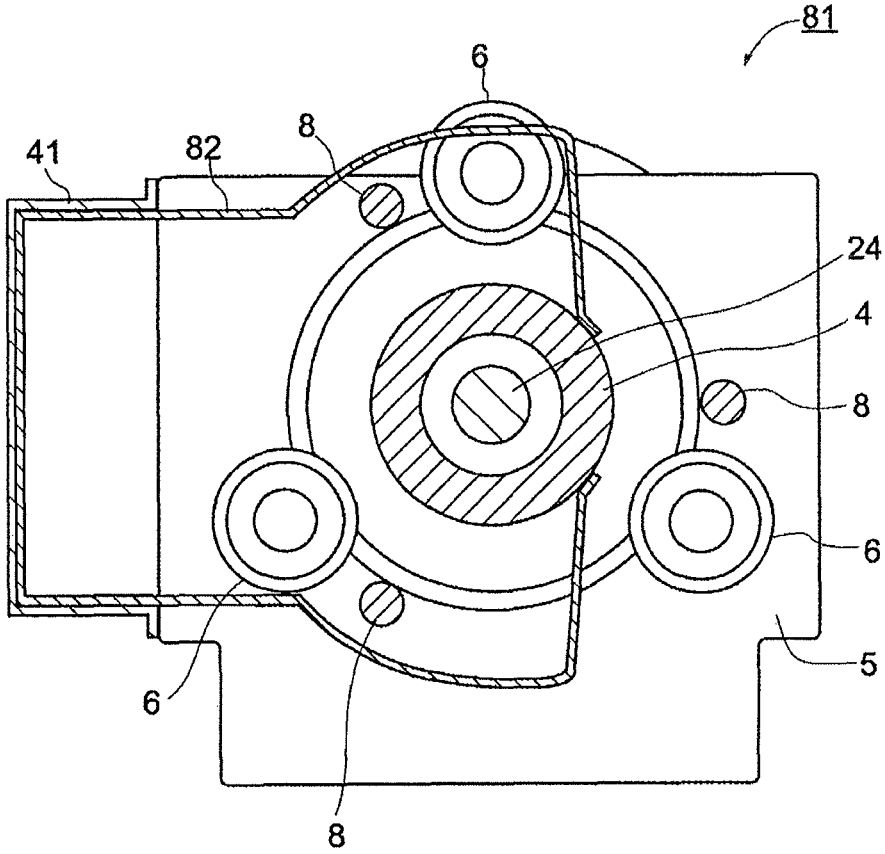
FIG. 12 is a cross-sectional view of a scroll air compressor according to a fourth embodiment of the present invention as seen from the same side as FIG. 5.

In FIG. 12, reference numeral 81 denotes a scroll air compressor according to the fourth embodiment of the present invention. Also, reference numeral 82 denotes a resin guide duct, communicating with the side duct 41, and surrounding the outer periphery of the bushing 4 provided on the other end of the casing 2. The guide duct 82 is provided at a partial periphery on the other end of the casing 2. That is, the guide duct 82 surrounds the other side in the lateral direction of the bushing 4 of the casing 2 through a space.

According to the scroll air compressor 81 according to the fourth embodiment of the present invention including the above-identified structure, therefore, advantageous effects similar to those in the scroll air compressor 1 according to the first embodiment of the present invention as described above can be also obtained. In addition, the guide duct 82 is provided at a partial periphery of the casing 2, thereby allowing miniaturization or reduction in weight of the scroll air compressor 81.

Fifth Embodiment

Next, a fifth embodiment of the present invention will be described with reference to FIG. 13. In the fifth embodiment shown in FIG. 13, the same elements as those in the above-described first embodiment shown in FIGS. 1 to 8 are designated by the same reference numerals as those described above, and the descriptions thereof will not be repeated.

Figure 13:
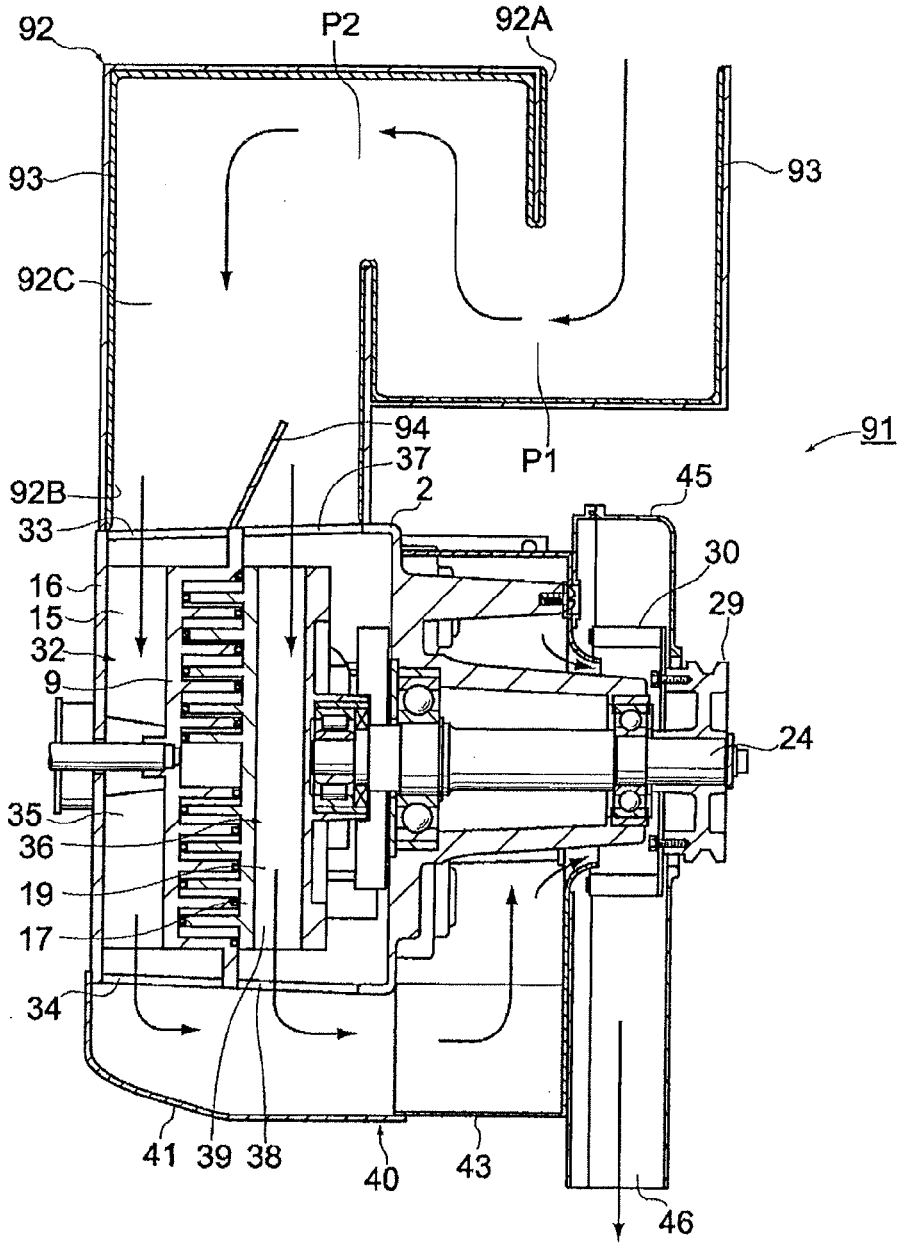
FIG. 13 is a longitudinal sectional view of a scroll air compressor according to a fifth embodiment of the present invention.

In FIG. 13, reference numeral 91 denotes a scroll air compressor according to the fifth embodiment of the present invention. The scroll air compressor 91 is provided with an inlet duct 92 attached to the scroll air compressor 1 according to the first embodiment of the present invention as described above.

More specifically, reference numeral 92 is an inlet duct connected to both the fixed inlet 33 and the orbiting inlet 37. The inlet duct 92 is a common duct capable of cooling both the fixed scroll 9 and the orbiting scroll 17.

The inlet duct 92 is provided with a duct inlet 92A on one end thereof, and a duct outlet 92B on the other end thereof. Between the duct inlet 92A and the duct outlet 92B, there is formed a flow path 92C in a nonlinear shape, i.e. in a maze (labyrinth) of shape. In other words, the flow path 92C is bent in such a manner that the fixed inlet 33 and the orbiting outlet 37 disposed at the duct outlet 92B cannot be seen from the outside through the duct inlet 92A. More specifically, the flow path 92C is bent 180 degrees at a position P1 close to the duct inlet 92A, and then, further bent 180 degrees at a position P2 close to the duct outlet 92B. Also, a noise absorbing material 93 is attached to the internal face of the inlet duct 92.

Reference numeral 94 denotes a baffle plate disposed between the fixed inlet 33 and the orbiting inlet 37. The baffle plate 94 is provided for adjusting the ratio between the quantity of cooling air flowing into the fixed inlet 33 and the quantity of cooling air flowing into the orbiting inlet 37. For example, as shown in FIG. 13, by inclining the front end of the baffle plate 94 to the other axial side of the scroll air compressor 91, it is possible to increase the quantity of cooling air flowing into the fixed inlet 33 and decrease the quantity of cooling air flowing into the orbiting inlet 37. The baffle plate 94 is a thin plate formed of, for example, a resin material, and attached to internal faces of upper and lower walls of the inlet duct 92 in the vicinity of the duct outlet 92B.

In the scroll air compressor 91 according to the fifth embodiment of the present invention including the above-described structure, the motor is driven so as to rotate the centrifugal fan 30, thereby sucking in outside air through the duct inlet 92A of the inlet duct 92. The sucked-in air flows, through the flow path 92C of the inlet duct 92, into the fixed inlet 33 and the orbiting inlet 37 of the scroll air compressor 91 from the duct outlet 92B to become cooling air for cooling the fixed scroll 9, the orbiting scroll 17, and the like.

According to the scroll air compressor 91 according to the fifth embodiment of the present invention as described above, the flow path 92C in a nonlinear shape (i.e. in a maze or labyrinth of shape) of the inlet duct 92 allows a reduction of noise generated when sucking in outside air to create cooling air during drive of the scroll air compressor 91. In addition, the noise absorbing material 93 attached to the internal face of the inlet duct 92 allows a further reduction of noise.

Also, the baffle plate 94 is disposed between the fixed inlet 33 and the orbiting inlet 37, thereby allowing an adjustment of the ratio between the quantity of cooling air flowing into the fixed inlet 33 and the quantity of cooling air flowing into the orbiting inlet 37. Thus, it is possible to realize a proper cooling effect according to operating environment, operating condition, or the like, of the scroll air compressor 91, such as a reduction of variations in the cooling effect between the fixed scroll 9 and the orbiting scroll 17, or a positive enhancement of the cooling effect of either one of the fixed scroll 9 and the orbiting scroll 17.

In the above-described fifth embodiment, the flow path 92C of the inlet duct 92 is formed in a maze of shape bent 180 degrees at two portions. However, measure of the bending angles and the number of bending positions or portions of the flow path 92C are not limited to this embodiment. For example, the flow path 92 C may be bent 90 degrees, or alternatively can be bent at one portion, or at three or more portions.

Sixth Embodiment

Next, a sixth embodiment of the present invention will be described with reference to FIG. 14. In the sixth embodiment shown in FIG. 14, the same elements as those in the above-described first embodiment shown in FIGS. 1 to 8 are designated by the same reference numerals as those described above, and the descriptions thereof will not be repeated.

Figure 14:
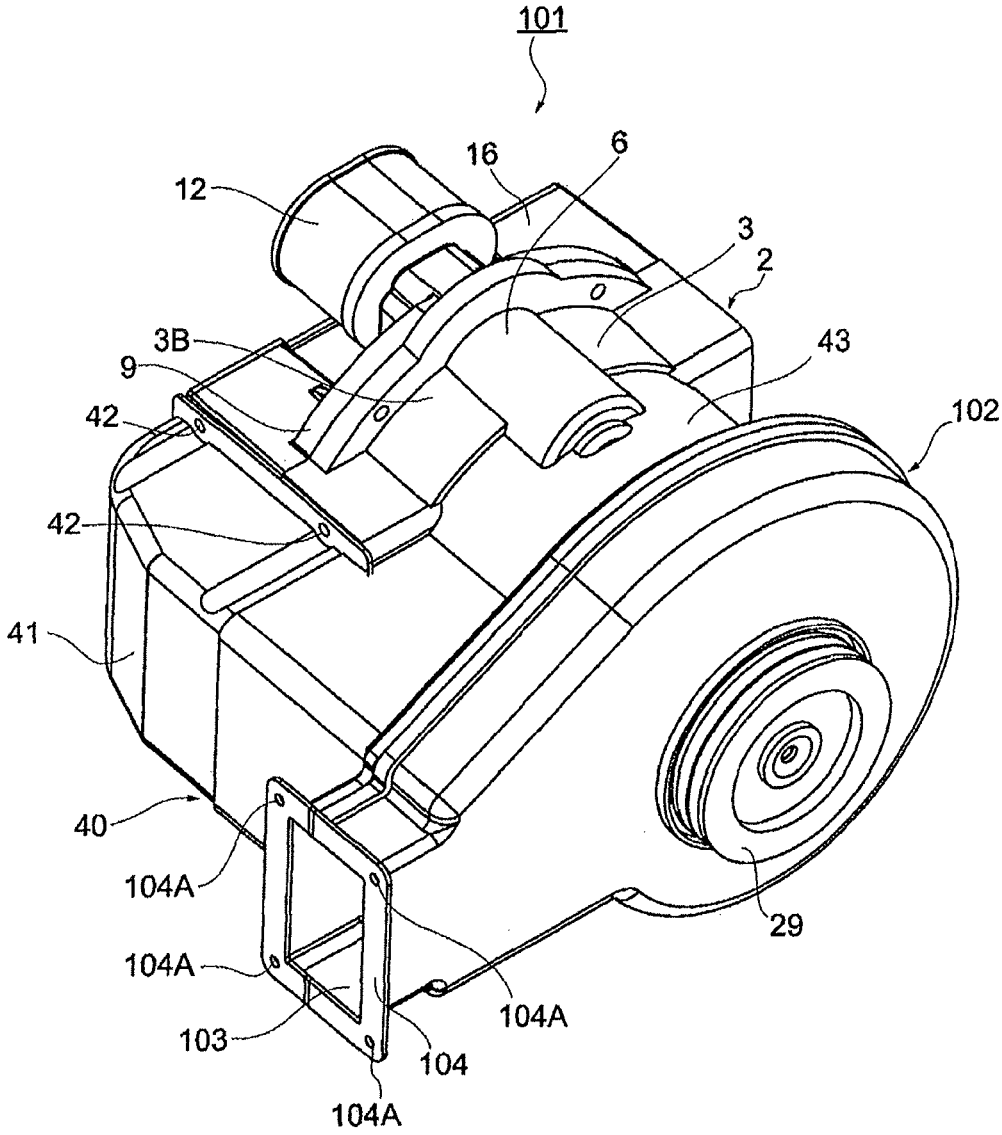
FIG. 14 is a perspective view of a scroll air compressor according to a sixth embodiment of the present invention.

In FIG. 14, reference numeral 101 denotes a scroll air compressor according to the sixth embodiment of the present invention. Also, reference numeral 102 denotes a fan cover surrounding the centrifugal fan 30 (see FIG. 2), with an inner peripheral portion connected to the other end of the guide duct 43 and with an outer peripheral portion having an exhaust port 103 for discharging the cooling air coming from the centrifugal fan 30. The fan cover 102 includes the structure similar to the fan cover 45 according to the first embodiment as described above, however, a flange 104 is provided on the peripheral edge of the exhaust port 103. Also, bolt through-holes 104A are formed in the flange 104.

Also, for example, when installing the scroll air compressor 101 in a package for a soundproof structure, an exhaust duct provided on the package and the exhaust port 103 of the scroll air compressor 101 are connected to each other through the flange 104. More specifically, the exhaust port 103 is secured to the exhaust duct by fastening bolts into screw holes formed in the vicinity of the exhaust duct of the package through the bolt through-holes 104A formed in the flange 104.

According to the scroll air compressor 101 with this structure, the exhaust port 103 can be easily and securely fixed to the exhaust duct of the package.

In the above-described respective embodiments, an oilless scroll air compressor is used as an example of the scroll fluid machine. However, the present invention is not limited to those embodiments, and also can be employed in any other scroll fluid machine such as a vacuum pump or an expansion machine.

What is claimed is:

1. A scroll fluid machine comprising:

a cylindrical casing with an opening at either least at one of a first axial end thereof and a second axial end thereof opposite the first axial end;

a fixed scroll provided at the opening on the first axial end of the casing, with a fixed wrap extending toward the casing;

an orbiting scroll provided in the casing and having an orbiting wrap with a compression chamber formed between the fixed wrap of the fixed scroll and the orbiting wrap;

a rotating shaft with one end engaging with the orbiting scroll to allow the orbiting scroll to perform an orbiting motion, and another end protruding from the opening of the second axial end of the casing; and a discharging centrifugal fan provided on the other end of the rotating shaft, the scroll fluid machine including:

a fixed cooling passage provided on a rear of the fixed scroll, with a fixed inlet opened to an environment external to the casing of the scroll fluid machine on one radial side of the fixed scroll and a fixed outlet on another radial side of the fixed scroll;

an orbiting cooling passage provided on a rear of the orbiting scroll, with an orbiting inlet opened to the environment external to the casing of the scroll fluid machine on the one radial side of the casing and an orbiting outlet on the another radial side of the casing; and a cooling air passage having a side duct communicating with the fixed outlet and the orbiting outlet located on one side surface of the casing, and a guide duct communicating with the side duct and connected to a fan cover disposed outside the centrifugal fan, the guide duct further surrounding an outer periphery of the second axial end of the casing.

2. The scroll fluid machine according to claim 1, wherein the fixed inlet and the orbiting inlet are oriented in a same direction, and the fixed outlet and the orbiting outlet are oriented in the same direction.

3. The scroll fluid machine according to claim 1, wherein a lateral surface on the first axial end of the casing is partially exposed to the environment external to the casing of the scroll fluid machine.

4. A scroll fluid machine comprising:

a metal cylindrical casing with a first axial end having a large diameter, a second axial end opposite the first axial end having a reduced diameter, and an opening at least at one of the first and the second axial end;

a metal fixed scroll provided at the opening on first axial end of the casing, with a fixed wrap extending toward the casing;

a metal orbiting scroll provided in the casing, and having an orbiting wrap with a compression chamber formed between the fixed wrap of the fixed scroll and the orbiting wrap;

a rotating shaft with one end engaging with the orbiting scroll to allow the orbiting scroll to perform an orbiting motion, and another end protruding from the opening of the other end of the casing; and a discharging centrifugal fan provided on the other end of the rotating shaft, the scroll fluid machine including:

a fixed cooling passage provided on a rear of the fixed scroll, with a fixed inlet opened to an environment external to the casing of the scroll fluid machine on one radial side of the fixed scroll and a fixed outlet on another radial side of the fixed scroll;

an orbiting cooling passage provided on a rear of the orbiting scroll, with an orbiting inlet opened to the environment external to the casing of the scroll fluid machine provided in the casing side-by-side with the fixed inlet and an orbiting outlet provided in the casing side-by-side with the fixed outlet;

a side duct with one end communicating with the fixed outlet and the orbiting outlet located on one side surface of the casing, and a resin duct with one end communicating with the side duct and surrounding an outer periphery of the second axial end of the casing, the side duct connecting the orbiting cooling passage and the fixed cooling passage to one side of the resin duct; and a resin fan cover disposed outside of the centrifugal fan, connected to the other end of the resin duct and having an exhaust port for discharging a cooling medium coming from the centrifugal fan.

5. The scroll fluid machine according to claim 1, wherein the side duct guides cooling air flowing out from the fixed outlet and the orbiting outlet to the guide duct.

6. The scroll fluid machine according to claim 4, wherein the orbiting cooling passage is provided between the rear of the orbiting scroll and a rear plate connected to the rotating shaft.

7. The scroll fluid machine according to claim 6, wherein the side duct guides cooling air flowing out from the fixed outlet and the orbiting outlet to the resin duct.

8. A scroll fluid machine comprising:

a metal cylindrical casing with a first axial end having a large diameter, a second axial end opposite the first axial end having a reduced diameter, and an opening at least at one of the first and the second axial end;

a leg provided on a side surface of the casing for supporting the scroll fluid machine with a central axis of the casing horizontal;

a metal fixed scroll provided at the opening on the first axial end of the casing, with a fixed wrap extending toward the casing;

a metal orbiting scroll provided in the casing, and having an orbiting wrap with a compression chamber formed between the fixed wrap of the fixed scroll and the orbiting wrap;

a rotating shaft with one end engaging with the orbiting scroll to allow the orbiting scroll to perform an orbiting motion, and another end protruding from the opening of the second axial end of the casing; and a discharging centrifugal fan provided on the other end of the rotating shaft, the scroll fluid machine including:

a fixed cooling fin provided on a rear of the fixed scroll;

a cooling fin cover surrounding the fixed cooling fin to form a fixed inlet opened to an environment external to the casing of the scroll fluid machine on one radial side of the fixed scroll and a fixed outlet on another radial side of the fixed scroll;

an orbiting cooling fin provided on a rear of the orbiting scroll;

an orbiting inlet opened to the environment external to the casing of the scroll fluid machine provided with an opening formed in a side surface of the casing;

an orbiting outlet provided with an opening formed in a side surface of the casing at a position opposed to the orbiting inlet;

an orbiting cooling passage provided on a rear of the orbiting scroll, between the orbiting inlet and the orbiting outlet;

a side duct with one end communicating with the fixed outlet and the orbiting outlet attached to only one side surface of the casing;

a resin duct with one end communicating with the side duct and surrounding an outer periphery of the second axial end of the casing, the side duct connecting the orbiting cooling passage and the fixed cooling passage to one side of the resin duct; and a resin fan cover disposed outside of the centrifugal fan, connected to an end of the resin duct, and having an exhaust port for discharging a cooling medium coming from the centrifugal fan.

9. The scroll fluid machine according to claim 8, wherein the orbiting cooling passage is provided between the rear of the orbiting scroll and a rear plate connected to the rotating shaft.

* * * * *